US009351617B2

(12) United States Patent
De Wit et al.

(10) Patent No.: US 9,351,617 B2
(45) Date of Patent: May 31, 2016

(54) DEVICE COMPRISING A MOVABLY ARRANGED FUNCTIONAL BODY AND A SAFETY MECHANISM FOR STOPPING MOVEMENT OF THE FUNCTIONAL BODY

(75) Inventors: Bastiaan Johannes De Wit, Groningen (NL); Fokke Roelof Voorhorst, Drachten (NL); Johannes Tseard Van Der Kool, Hurdegaryp (NL); Sepas Setayesh, Drachten (NL)

(73) Assignee: KONINKLIJKE PHILIPS B.V., Eindhoven (NL)

( * ) Notice: Subject to any disclaimer, the term of this patent is extended or adjusted under 35 U.S.C. 154(b) by 218 days.

(21) Appl. No.: 14/112,999

(22) PCT Filed: Apr. 23, 2012

(86) PCT No.: PCT/IB2012/052019

§ 371 (c)(1), (2), (4) Date: Oct. 21, 2013

(87) PCT Pub. No.: WO2012/150521

PCT Pub. Date: Nov. 8, 2012

(65) Prior Publication Data

US 2014/0041153 A1 Feb. 13, 2014

(30) Foreign Application Priority Data

May 3, 2011 (EP) ..... 11164543

(51) Int. Cl.

*A47L 9/04* (2006.01)
*A47L 11/40* (2006.01)

(52) U.S. Cl.

CPC ..... *A47L 9/04* (2013.01); *A47L 9/0427* (2013.01); *A47L 11/40* (2013.01); *A47L 11/4041* (2013.01); *A47L 11/4069* (2013.01)

(58) Field of Classification Search

CPC ..... A47L 9/04; A47L 9/0427; A47L 11/40; A47L 11/4069

See application file for complete search history.

(56) References Cited

U.S. PATENT DOCUMENTS

| | | | | |
|---|---|---|---|---|
| 4,317,253 | A | 3/1982 | Gut et al. | |
| 2003/0196294 | A1 | 10/2003 | Conrad | |
| 2008/0148512 | A1 * | 6/2008 | Beskow et al. | 15/350 |
| 2010/0299867 | A1 * | 12/2010 | Beskow et al. | 15/390 |

FOREIGN PATENT DOCUMENTS

| | | | |
|---|---|---|---|
| GB | 2468908 | A | 9/2010 |
| WO | 2006131029 | A1 | 12/2006 |

* cited by examiner

*Primary Examiner* — Randall Chin

(57) ABSTRACT

A device for performing an action on a surface comprises at least one movably arranged functional body (21, 22), driving means for driving the functional body (21, 22), main safety means for decoupling the driving means from the functional body (21, 22) when a load exerted by the functional body (21, 22) in the direction of the driving means under the influence of resistance forces experienced by the functional body (21, 22) exceeds a predetermined maximum value, and additional safety means (40) which are movably arranged in the vicinity of the functional body (21, 22), and which are capable of exerting loads on the main safety means to different extents in different positions, at a side of the main safety means associated with the functional body (21, 22). The additional safety means may comprise a bar (40) having a non-circular cross-sectional area, which is rotatable about its longitudinal axis (41).

16 Claims, 3 Drawing Sheets

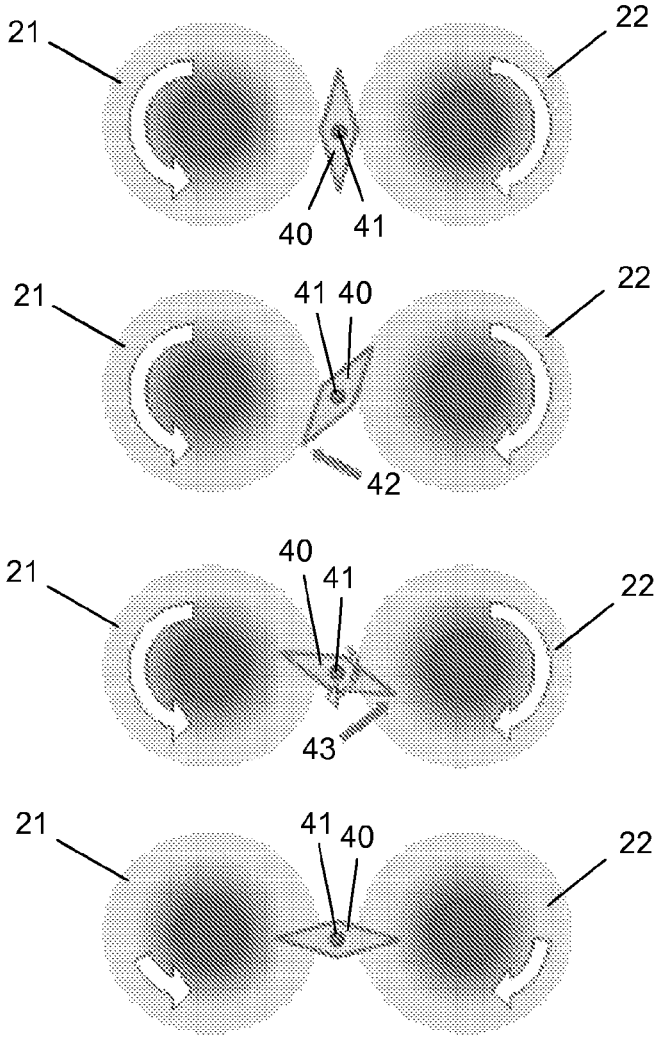
Fig. 5
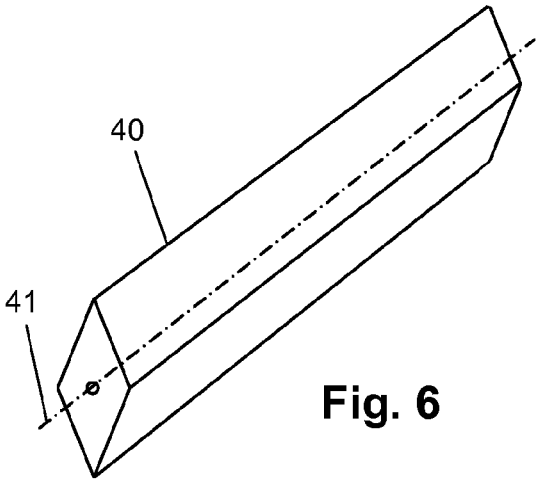
Fig. 6
Fig. 7
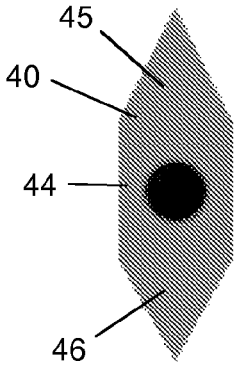

DEVICE COMPRISING A MOVABLY ARRANGED FUNCTIONAL BODY AND A SAFETY MECHANISM FOR STOPPING MOVEMENT OF THE FUNCTIONAL BODY

CROSS-REFERENCE TO PRIOR APPLICATIONS

This application is the U.S. National Phase application under 35 U.S.C. §371 of International Application No. PCT/IB2012/052019, filed on Apr. 23, 2012, which claims the benefit of European Patent Application No. 11164543.8, filed on May 3, 2011. These applications are hereby incorporated by reference herein.

FIELD OF THE INVENTION

The present invention relates to a device for performing an action on a surface, comprising at least one movably arranged functional body at a side of the device intended for facing the surface, driving means for driving the functional body, and safety means for decoupling the driving means from the functional body when a load exerted by the functional body in the direction of the driving means under the influence of resistance forces experienced by the functional body exceeds a predetermined maximum value.

BACKGROUND OF THE INVENTION

A device as mentioned is known from US 2003/196294. In the case described in this document, the device is an appliance for cleaning a surface, the functional body is a brush for removing dirt from the surface, and the safety means comprise a magnetic clutch which is arranged in a power transmission coupling between the brush and a motor for driving the brush.

According to the teaching of US 2003/196294, it may occasionally happen that when the cleaning appliance is used, and the brush is made to perform a rotating movement, the brush becomes entangled with foreign objects, which cause the brush to slow down or stop altogether. In such cases, the foreign object may be damaged by the strain applied to the object by the rotating brush when the brush becomes jammed. Alternately, or in addition, the motor for driving the brush may become damaged. For example, in case the motor is an electric motor, the motor could overheat by drawing an excessive current due to the brush jam condition.

By using a magnetic clutch, it is possible to stop the brush rotating if the brush becomes jammed. This type of clutch comprises two elements such as opposed plates which are provided with magnets. Under normal conditions, attractive forces between the magnets on the opposed plates will magnetically couple the plates together. Accordingly, the rotation of one plate will cause the other plate to rotate. However, as the plates are not physically connected, if a predetermined amount of torque is applied to one of the plates, which happens when the brush becomes jammed, the plates will become magnetically decoupled.

Consequently, continued rotation of one of the plates will not cause the opposed plate to rotate, whereby damage to the brush, any object entangled in the brush, as well as the motor for driving the brush is prevented.

A practical example of a foreign object which may cause the brush to jam is an electric cord lying on the surface to be cleaned. When this happens, an extremely dangerous situation may occur when the brush is not decoupled from the motor. The fact is that the brush and the cord can interact in such a way that the cord is stripped from its insulating layer, leaving the bear copper of the cord either to cause a short circuit, and thereby a possible fire, or to shock the user when trying to get the cord out by hand.

It appears in practice that the use of a clutch for decoupling the brush from the motor does not guarantee that damage to an electric cord does not occur. Especially when a relatively thick electric cord is encountered by the brush, it may happen that the cord does not wrap around the brush due to its inflexibility, so that the brush rubs over the cord, while the friction is not enough for reaching the level of torque at which the clutch decouples. In view of the possibility of such a situation, it is an object of the present invention to improve the safety mechanism of a device comprising at least one movably arranged functional body which is used in performing an action on a surface, such as a brush which is used in performing a cleaning action as described in the foregoing.

SUMMARY OF THE INVENTION

The object of the present invention is achieved by means of a device for performing an action on a surface, comprising at least one movably arranged functional body at a side of the device intended for facing the surface, driving means for driving the functional body, main safety means for decoupling the driving means from the functional body when a load exerted by the functional body in the direction of the driving means under the influence of resistance forces experienced by the functional body exceeds a predetermined maximum value, and additional safety means which are movably arranged in the vicinity of the functional body, and which are capable of exerting loads on the main safety means to different extents in different positions, at a side of the main safety means associated with the functional body.

As mentioned in the foregoing, the device may be a device for performing a cleaning action on a floor or another type of surface, and the functional body may comprise a brush, for example, a brush having a cylindrical shape, which is rotatable about the longitudinal axis of the cylinder shape. Furthermore, the main safety means may comprise a clutch, for example, a magnetic clutch as known from US 2003/196294, in which case a decoupling action involves slipping of the clutch, or a clutch having one or more shearing elements. The clutch can be located at any suitable position for decoupling the driving means from the functional body, wherein it is possible for the clutch to be integrated in the functional body if so desired, to mention an example of a position. In this respect, it is noted that when the functional body comprises a brush, indeed, a suitable position of the decoupling action of the main safety means is a position between the driving means and the brush hairs, wherein the main safety means may be arranged such as to cause breakage of an output shaft of the driving means, for example, or may be arranged at a different end of the range of possibilities, namely such as to decouple a carrier element supporting hairs of the brush from a core portion of the brush.

A special feature of the device according to the present invention is constituted by the additional safety means. As indicated in the foregoing, these means are movable, and are capable of exerting loads on the main safety means to different extents in different positions, at a side of the main safety means associated with the functional body. It will now be explained how such means can actually contribute to the level of safety in the device. On the basis of their movable arrangement and their capability of varying the extent to which they exert loads on the main safety means, it is possible to have both a default position of the additional safety means in which they exert only a minimum load on the main safety means, so that the main safety means are not triggered to perform a decoupling action under the influence of the additional safety means, and an activated position of the additional safety means in which they exert a load on the main safety means which is considerably higher than the minimum load, so that a significant contribution to a total load experienced by the main safety means in the direction of the driving means can be obtained, wherein the total load may be high enough for causing a decoupling action of the main safety means to take place. According to a practical possibility, the additional safety means are adapted to exert loads on the main safety means in an indirect manner, namely through another component of the device for performing an action on a surface. For example, the additional safety means may be adapted to cause loads to be exerted on the main safety means through the functional body. Particularly, in that case, the additional safety means are capable of contacting the functional body and thereby exerting resistance forces on the functional body to different extents in different positions. A default position is a position in which contact of the additional safety means to the functional body is at a minimum level, so that the movement of the functional body is hardly hindered during operation of the device, and an activated position is a position in which the contact as mentioned is at a considerably higher level, as a result of which the functional body transmits a load towards the driving means. The additional safety means are arranged in the vicinity of the functional body, wherein the location of these means can be such that when the functional body encounters a foreign object, these means encounter this object as well, and are made to move from the default position to an activated position as a result thereof. In this way, a situation is obtained in which the load exerted by the functional body in the direction of the driving means is enhanced under the influence of contact between the functional body and the foreign object in the first place, and is even further enhanced under the influence of contact between the functional body and the additional safety means in the second place. Hence, even when the first factor is not sufficient for causing the main safety means to perform their decoupling function, which may be the case when the foreign object is a relatively thick electric cord, for example, the second factor surely is, so that the decoupling function of the main safety means is guaranteed, and damage to the foreign object, the functional body and/or the driving means is prevented.

When the present invention is applied, an improvement of known safety measures, which involve the use of a clutch, is obtained on the basis of the fact that resistance forces experienced by the functional body when a foreign object is encountered are complemented with a load following from activation of the additional safety means, which may be caused by contact between the additional safety means and the foreign object, as explained in the foregoing. Without the use of the additional safety means, a situation may occur in which the resistance forces exerted by a foreign object on the functional body are not high enough for triggering the main safety means to decouple the functional body from the driving means, while being sufficient and prevailing sufficiently long for causing damage to occur, and the situation may turn out to be very dangerous for a user, especially when the foreign object is an electric cord or the like. For sake of clarity, it is noted that resistance forces should be understood such as to mean forces counteracting a movement of the functional body, such as frictional forces resulting from contact. Another example of resistance forces applies to the situation in which the functional body comprises a brush, when resistance is not only caused by friction, but also by impact on a foreign object of hairs of the brush, and of air put in motion by the brush.

In a practical embodiment, the additional safety means may comprise an element for performing the function of contacting the functional body, which element is movable between at least one position in which a level of contact between the element and the functional body is at a minimum, wherein there may even be no contact at all, and at least one other position in which the element contacts the functional body to a much higher extent. According to one possibility existing within the scope of the present invention, the element may be an element which is rotatable about a rotation axis, and which has various radial dimensions with respect to the rotation axis. With the various radial dimensions, it is possible to have at least one position associated with a relatively small radius in which there is minimal contact to the functional body, and at least one position associated with a relatively large radius in which there is an increased level of contact to the functional body.

Especially in case the functional body comprises a brush or the like having a cylindrical shape, it is very practical for the additional safety means to comprise a bar which is rotatable about its longitudinal axis, and which has a non-circular cross-sectional area. In such a case, the bar and the functional body may be arranged such as to extend substantially parallel with respect to each other. When the position of the bar is such that a portion of the bar having a relatively small radius faces the functional body, there can be a situation in which there is minimal contact of the bar to the functional body, and when the position of the bar is such that a portion of the bar having a relatively large radius faces the functional body, there can be a situation in which there is an increased level of contact of the bar to the functional body. The first position can be chosen as a default position of the bar. When a foreign object is encountered by the functional body and the bar, a rotation of the bar about its longitudinal axis is obtained as the object on the one hand and the functional body and the bar on the other hand move with respect to each other, which causes the bar to more intensely contact the functional body, so that additional resistance forces are exerted on the functional body, and the main safety means are activated as a result thereof.

The non-cylindrical cross-sectional area of the bar may be a diamond-shaped cross-sectional area, for example. Such a bar clearly has a smallest dimension, namely along a short axis of the diamond shape, and a largest dimension, namely along a long axis of the diamond shape. According to another possibility, the bar may comprise a rectangular central portion and two triangular portions located on opposite sides of the central portion. According to yet another possibility, the bar may have a rectangular cross-sectional area. In the latter case, the bar is very stable against false triggers, but is not very sensitive to foreign objects such as cords. In case of a diamond shape, this is more or less the other way around, i.e. the stability against false triggers is relatively low, and the sensitivity to foreign objects is relatively high. When the bar has a rectangular central portion and two triangular portions located on opposite sides of the central portion, this is in fact a combination of a rectangular shape and a diamond shape, wherein it is possible to have both a high stability against false triggers and a high sensitivity to foreign objects.

Another factor influencing the stability of the rotatable bar is the positioning of the longitudinal axis of the bar with respect to an axis about which the functional body is rotatable, in a situation in which the movable arrangement of the functional body is a rotatable arrangement. It is preferred to provide the bar with thickness, and/or to give the bar lag, i.e. to let the longitudinal axis of the bar extend at another level in the device than the axis about which the functional body is rotatable, wherein each level is at a different distance with respect to the surface to be treated by means of the device in an operational position of the device with respect to the surface. In particular, as far as the option of giving the bar lag is concerned, it is preferred when the longitudinal axis of the bar extends at a level in the device at which the bar is positioned further outward than the axis about which the functional body is rotatable, i.e. at a level at which the longitudinal axis of the bar is closer to the surface to be treated by means of the device than the axis about which the functional body is rotatable in an operational position of the device with respect to the surface, as in such a case, the stability of the bar can be highest. In fact, when the option of having outward lag is chosen, optimal positioning of the bar can be realized by having an optimal combination of stability and functionality, wherein the latter involves being free from contact to the functional body in a default position, and contacting the functional body in an activated position.

The device can comprise more than one functional body, for example, two functional bodies. In such a case, it is advantageous if the additional safety means are arranged at a position between the bodies, so that the additional safety means are capable of contacting both functional bodies in case it encounters a foreign object and is moved by that object. When there are two functional bodies, the main safety means may comprise one clutch for both functional bodies, or two clutches, wherein each of the clutches is associated with another of the functional bodies. Whatever the situation may be, by applying the additional safety means, in an embodiment in which they are capable of contacting the functional bodies, it is achieved that additional resistance forces are exerted on the functional bodies, so that the main safety means are triggered in an effective manner, wherein damage of any kind and danger for a user are prevented.

It is advantageous if measures are taken for avoiding a situation in which a user can simply restart the device without removing the foreign object first. In this respect, the device may comprise sensing means for sensing a decoupling action of the main safety means during operation of the device and emitting a controlling signal in case a decoupling action takes place, and controlling means for receiving the controlling signal, terminating the operation of the driving means upon receipt of the signal, and demanding a manual reset from a user of the device before the driving means can be put into operation again. Another option is that the sensing means are adapted to sense a movement of the additional safety means during operation of the device and to emit a controlling signal in case the movement is larger than a predetermined maximum. In case the additional safety means comprise a bar as described in the foregoing, the predetermined maximum of the movement of the additional safety means may be a rotation of the bar for 40 degrees, for example.

The present invention is applicable in various cases. A specific case is a case in which the functional body comprises a brush having soft and flexible brush hairs, wherein a linear mass density of the brush hairs is lower than 150 g per 10 km. With such a brush, when a foreign object is encountered, the object can easily reach a core portion of the brush. When the object is an electric cord, contact between the cord and the core portion of the brush causes the cord to get stripped of its insulating layer in a very short period of time if the brush is not decoupled from the driving means as quickly as possible. On the basis of the functionality of the additional safety means according to the present invention, it is guaranteed that a load exerted on the main safety means almost immediately rises to such a level that activation of the main safety means is realized.

In respect of a device having a brush with soft and flexible brush hairs as mentioned, it is noted that such a device is suitable to be used as a cleaning device, which may comprise means for realizing a suction force at a head of the device where the brush is arranged, like a vacuum cleaner, but which can also be realized without such means. In any case, with the particular type of brush as mentioned, a cleaning action of a surface is not performed by scrubbing the surface, as may normally be expected when a brush is used, but by putting the brush hairs alternately in and out of contact with the surface during rotation of the brush. In particular, during one revolution of the brush, the brush hairs remove particles and/or liquid droplets from a soiled surface on the basis of the fact that the particles and/or the droplets adhere to the brush hairs, or are at least pushed from their initial place by the brush hairs, and fling away the particles and/or the droplets when they reach a position in which they are free from contact to the surface and in which they can be fully outstretched. Advantageously, in the head of the cleaning device, there are means for receiving the particles and/or the droplets, and for possibly transporting the particles and/or the droplets towards a space where they are collected.

In order to have an effective process of flinging away particles and/or droplets which have been removed from a surface, the rotation of the brush needs to take place at a certain angular velocity. The angular velocity of the brush may be chosen to be such that an acceleration at tips of the brush hairs can be higher than 3,000 m/sec$^2$ at some point, which is the case when the angular velocity is at least 6,000 revolutions per minute, and a diameter of the brush is in a range of 20 to 80 mm when the brush hairs are fully outstretched, for example. Furthermore, it is possible for the cleaning device to supply a cleaning liquid to the rotating brush in order to promote the adherence of particles to the brush hairs and/or to realize an additional cleaning effect on a surface to be cleaned, but this is not necessary.

The above-described and other aspects of the present invention will be apparent from and elucidated with reference to the following detailed description of a device which is suitable to be used for cleaning surfaces such as floors, and which comprises two rotatable brushes and a safety mechanism for stopping the brushes when a foreign object such as an electric cord is encountered, which safety mechanism comprises a bar which is rotatably arranged in the vicinity of the brushes, besides clutches for decoupling the brushes from a motor for driving them.

BRIEF DESCRIPTION OF THE DRAWINGS

The present invention will now be explained in greater detail with reference to the figures, in which equal or similar parts are indicated by the same reference signs, and in which:

FIG. 5 illustrates an application of the safety bar in the cleaning device, at a position between the brushes, wherein four stages of a rotation of the safety bar about its longitudinal axis are shown;

FIG. 6 shows a perspective view of the safety bar; and

FIG. 7 shows a preferred shape of a cross-sectional area of the safety bar.

DETAILED DESCRIPTION OF EMBODIMENTS

Figure 1:
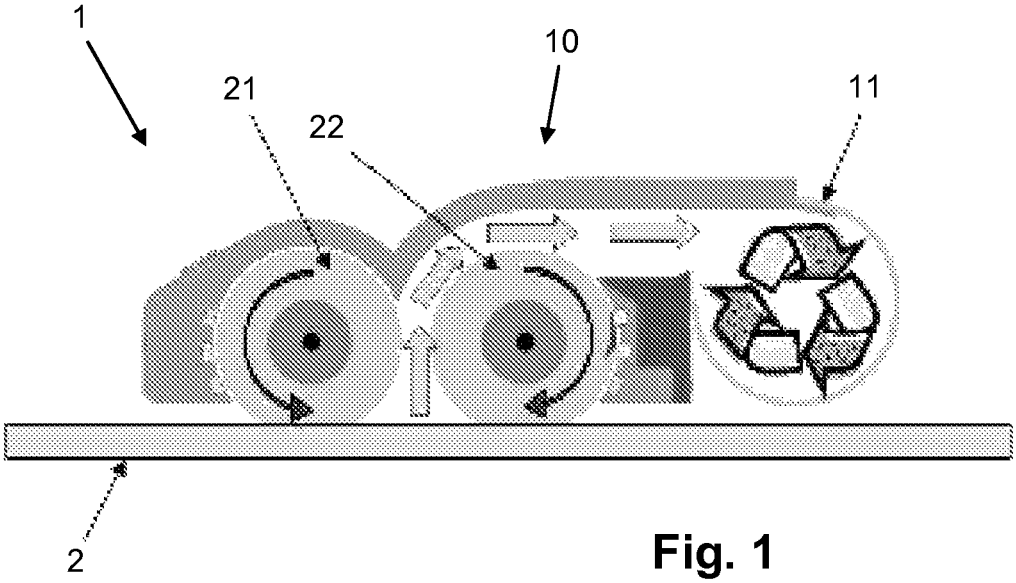
FIG. 1 diagrammatically shows a sectional view of a head of a cleaning device comprising two rotatable brushes.

FIG. 1 shows a head 10 of a cleaning device 1 accommodating two rotatable brushes 21, 22. The cleaning device 1 is suitable to be used for cleaning surfaces such as floors, wherein the brushes 21, 22 are intended for contacting the surfaces to be cleaned, and are arranged at an open side of the brush accommodating head 10 for that purpose. For sake of completeness, it is noted that FIG. 1 shows the brush accommodating head 10 in a normal, functional position for cleaning a horizontal surface 2, and that the directions in which the brushes 21, 22 are rotated during operation of the device are indicated by means of bent arrows.

The brushes 21, 22 are as soft as paint rollers, and are provided with a plurality of extremely flexible hairs, which are capable of picking up particles and/or droplets from the surface 2 on the basis of adherence effects, and which are furthermore capable of releasing the picked-up particles and/or droplets at a position inside the brush accommodating head 10. In fact, when the brushes 21, 22 are rotated, the brush hairs pick up particles and/or droplets in one part of each revolution, and fling away the picked-up particles and/or droplets in another part of each revolution. It is preferred for the brushes 21, 22 to be kept at a position with respect to the surface 2 in which the brushes 21, 22 are indented at the side where the surface 2 is, as a length along which the brush hairs contact the surface 2 is enlarged in this way, and the effect of releasing picked-up particles and droplets is enhanced during a stage in which the brush hairs move from an indented condition to an outstretched condition. The cleaning action performed by means of the brushes 21, 22 is more or less comparable to a cleaning action of a car wash.

The cleaning device 1 comprises means (not shown) for creating a suction force at the brush accommodating head 10 on the basis of a vacuum. Under the influence of the suction force, the particles and/or droplets released by the brushes 21, 22 are transported further to a defined space 11 inside the cleaning device 1, as indicated by means of a number of straight arrows in FIG. 1. Inside this space 11, air-dirt separation takes place in a manner known per se, as indicated by means of bent arrows arranged in a circle in FIG. 1, whereby it is achieved that the particles and/or droplets stay behind in this space 11, while clean air is let out.

For sake of completeness, it is noted that the cleaning device 1 is suitable for both dry cleaning and wet cleaning. The cleaning device 1 may have means for supplying a cleaning liquid to the surface 2, possibly through the brushes 21, 22, but this is not necessary. It is also possible for the cleaning device 1 to use liquid which is already present on the surface 2. This liquid may even be soiled liquid, as most of the liquid is removed from the surface 2 by the hairs of the brushes 21, 22 in the end.

It may happen that an object is present on the surface 2. If a user of the cleaning device 1 does not notice this object in time and does not take the appropriate action of moving it out of the way or moving the brush accommodating head 10 around it, this object is encountered by the rotating brushes 21, 22. In case the object is an electric cord, the cord is picked up by the brushes 21, 22 and transported into the brush accommodating head 10, wherein there is a high risk that the cord gets damaged by the brushes 21, 22, especially in view of the fact that is preferred for the brushes 21, 22 to rotate at a rather high speed in order to be effective in a cleaning action, for example, a speed in an order of 7,000 revolutions per minute. In addition to a high risk of damage, there is an associated risk of electrocution or fire as a result of the brushes 21, 22 rubbing against the insulating layer of the cord and destroying the insulating layer, resulting in non-insulated electric wires.

Figure 2:
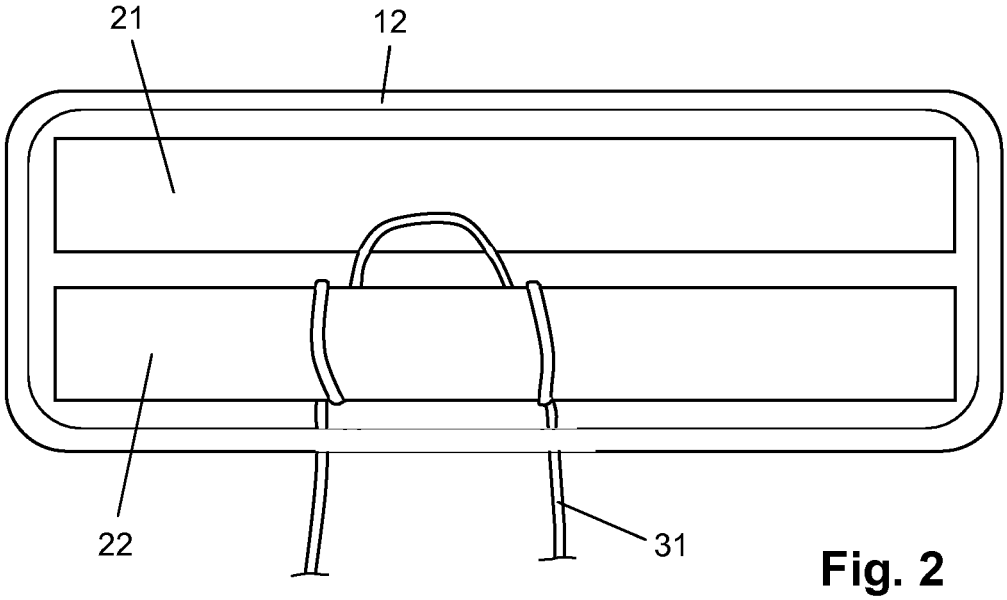
FIG. 2 illustrates how a relatively thin electric cord can be wrapped around one of the brushes when it is encountered by the head of the cleaning device.

FIG. 2 serves to illustrate what happens when a relatively thin electric cord 31 is encountered by the brush accommodating head 10. When the cord 31 gets in contact with one of the brushes 21, 22, the brush hairs tend to wrap around it, more or less like a whip, and pull the cord 31 inside the brush accommodating head 10. At this stage, the cord 31 is not damaged, but is effectively picked up by the brush 21, 22 concerned. However, as the brushes 21, 22 continue to rotate, the cord 31 is wrapped around the brush 21, 22 concerned, thereby creating a strap brake which is pressed against a core portion of the brush 21, 22. In the process, frictional forces occur, so that heat is created, under the influence of which the insulating layer of the cord 31 melts away when no safety measures are taken for stopping this process right away. FIG. 2 shows how the electric cord 31 can end up in a position in which it is wrapped around one of the brushes 21, 22.

It is also possible for a relatively thin electric cord 31 to end up being wrapped around both brushes 21, 22 and being stripped from its insulating layer. In any case, when a relatively thin electric cord 31 is encountered by the brush accommodating head 10 of the cleaning device 1 in the course of a cleaning action, it is likely to occur that the cord 31 is pulled into the brush accommodating head 10 really hard, and is stripped in an extremely short period of time, even in less than a second, due to the high frictional forces acting between the core of at least one of the brushes 21, 22 and the cord 31.

Figure 3:
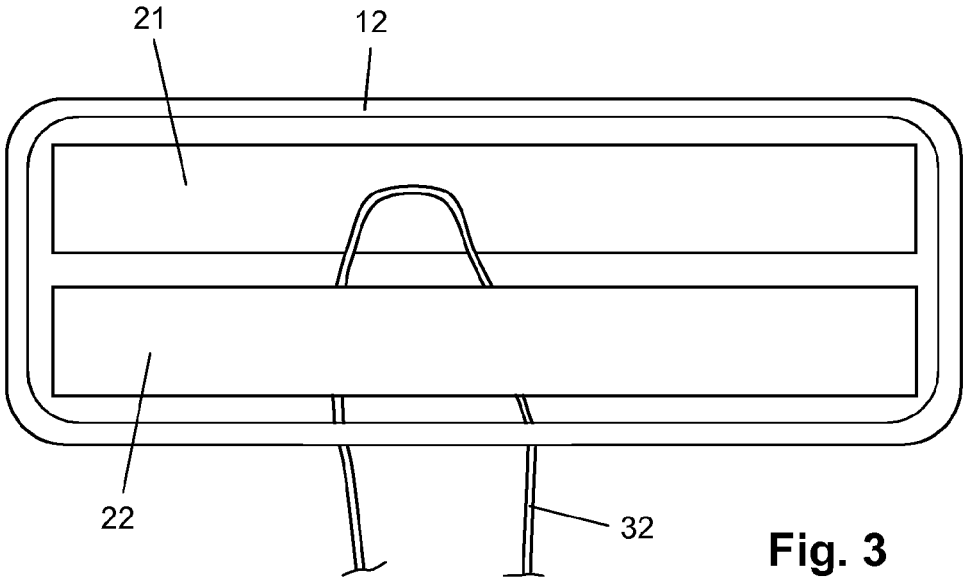
FIG. 3 illustrates how a relatively thick electric cord can be pushed against a core portion of one of the brushes when it is encountered by the head of the cleaning device.

FIG. 3 serves to illustrate what happens when a relatively thick electric cord 32 is encountered by the brush accommodating head 10. A relatively thick electric cord 32 is less flexible than a relatively thin electric cord 31, to such an extent that it will not be wrapped around one or both brushes 21, 22. In general, a relatively thick electric cord 32 can be expected to stay under one brush 21, 22 and to be lifted up and lie on the other brush 21, 22. As a result of the fact that the electric cord 32 is lifted by the second brush 21, 22, the electric cord 32 is pushed towards the core portion of the first brush 21, 22. In the process, elevated levels of frictional power are created, and the electric cord 32 is stripped from its insulating layer in a matter of seconds when no safety measures are taken for stopping this process right away. FIG. 3 shows how the electric cord 32 can end up in a position in which it lies under one of the brushes 21, 22 and is lifted by the other of the brushes 21, 22. For sake of completeness, it is noted that in FIG. 3, a top view of the brushes 21, 22 is shown, so that the side of the brushes 21, 22 which is visible in the figure is the side facing away from the surface where the electric cord 32 is picked up. The same is applicable to FIG. 2. Furthermore, it is noted that in both FIGS. 2 and 3, only the brushes 21, 22, a frame element 12 of the brush accommodating head 10 surrounding the brushes 21, 22, and a portion of the electric cord 31, 32 are shown.

Figure 4:
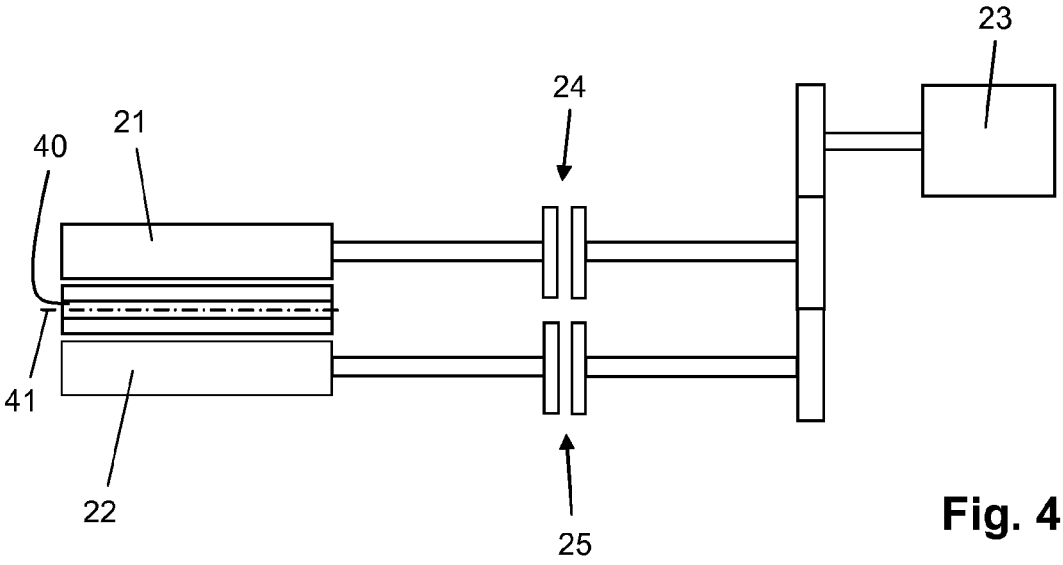
FIG. 4 shows a block diagram of a number of components of the cleaning device, particularly the brushes, a motor for driving the brushes, clutches arranged between each of the brushes and the motor, and a safety bar.

FIG. 4 diagrammatically shows a number of components of the cleaning device 1. Besides the brushes 21, 22, the cleaning device 1 comprises a motor 23 for driving the brushes 21, 22, and clutches 24, 25 arranged between each of the brushes 21, 22 and the motor 23. The clutches 24, 25 are part of a safety mechanism of the cleaning device 1, and serve for limiting the torque that is transmitted to the brushes 21, 22. When a foreign object such as an electric cord 31, 32, especially a relatively thin electric cord 31, is encountered by a brush 21, 22, a relatively high torque is suddenly obtained, as a result of which the clutch 24, 25 associated with the brush 21, 22 concerned starts slipping. With the clutch 24, 25 in the slipping state, no more driving power is transmitted to the brush 21, 22, so that the chance that the electric cord 31, 32 gets damaged is eliminated. For sake of completeness, it is noted that it is also possible for the cleaning device 1 to be equipped with only one clutch 24, 25, wherein both brushes 21, 22 are associated with that clutch 24, 25. However, it is advantageous to use two clutches 24, 25, because in that case, the safety mechanism is more sensitive to loads which are exerted on each individual brush 21, 22.

In the cleaning device 1, it is preferred to use a type of clutch 24, 25 that is capable of decoupling the brushes 21, 22 from the motor 23. For example, the clutches 24, 25 may be magnetic clutches 24, 25 which resist a torque up to a certain level. Once that level is exceeded, the clutches 24, 25 will slip and thereby perform a decoupling function.

According to the present invention, the safety mechanism of the cleaning device 1 does not only comprise at least one clutch 24, 25, but also comprises a safety bar 40, which is arranged such as to be rotatable about its longitudinal axis 41, and which is arranged at a position between the brushes 21, 22. In a more general wording, it can be said that the safety mechanism comprises main safety means 24, 25 for decoupling the motor 23 from one brush 21, 22 or both brushes 21, 22 when a torque exerted by the brush 21, 22 or brushes 21, 22 in the direction of the motor 23 under the influence of resistance forces experienced by the brush 21, 22 or brushes 21, 22 exceeds a predetermined maximum value, and additional safety means 40 which are movably arranged in the vicinity of at least one brush 21, 22, and which are capable of contacting the brush 21, 22 and thereby exerting resistance forces on the brush 21, 22 to different extents in different positions. In the case of the safety bar 40, the capability as mentioned can be achieved when the safety bar 40 has a non-circular cross-sectional area.

The function of the safety bar 40 is amplifying the torque when an electric cord 31, 32 enters the brush accommodating head 10. Without a safety bar 40, only the electric cord 31, 32 can create a torque on at least one of the brushes 21, 22. In practice, it appears that this works pretty well with relatively thin cords 31, as in that case, a kind of strap brake effect with a brush 21, 22 is created, as explained in the foregoing. However, this does not appear to work in a reliable manner with thicker cords 32. By using a safety bar 40, which is arranged such as to be rotated about its longitudinal axis 41 under the influence of contact to a cord 31, 32 or the like, and to thereby create an increased level of contact to the brushes 21, 22, this problem is solved. An increased level of contact of the safety bar 40 to a brush 21, 22 automatically involves an increased level of resistance forces acting on the brush 21, 22, so that the main safety means, i.e. the at least one clutch 24, 25, is surely triggered to decouple the brush 21, 22 from the motor 23.

The functioning of the safety bar 40 will be further explained on the basis of FIG. 5, in which it is shown how the safety bar 40 can be arranged with respect to the two brushes 21, 22, and how the safety bar 40 can be rotated from one position to another in case an electric cord 31, 32 is encountered. For sake of clarity, however, an incoming electric cord 31, 32 is not shown in FIG. 5, and the same goes for the motor 23 for driving the brushes 21, 22 and the clutches 24, 25 arranged between the brushes 21, 22 and the motor 23. In the shown example, the cross-sectional area of the safety bar 40 is constant over its length, and has a diamond shape. A perspective view of the safety bar 40 is shown in FIG. 6, wherein the longitudinal axis 41 of the safety bar 40 is indicated by means of a dash and dot line, which is also the case in FIG. 4. The length of the safety bar 40 may be practically the same as the length of the brushes 21, 22 in order to be most effective, but it is also possible that the safety bar 40 on the one hand and the brushes 21, 22 on the other hand have different lengths. In FIG. 5, the direction of rotation of the brushes 21, 22 is indicated by means of bent arrows. At the top of FIG. 5, brushes 21, 22 and the safety bar 40 is shown with the safety bar 40 in an initial position, i.e. a position which is associated with a normal operational situation of the cleaning device 1, in which there is no foreign object inside the brush accommodating head 10. In the shown example, the safety bar 40 is arranged such as to only contact the brushes 21, 22 to a minimal extent. To this end, the dimension of a short axis of the diamond shape is chosen such as to be hardly any larger than a distance between the brushes 21, 22 in the area where the safety bar 40 is arranged.

When the safety bar 40 is in the initial position, and an electric cord 31, 32 enters the brush accommodating head 10, a situation is obtained in which the cord 31, 32 pushes or rubs against a lower half of the safety bar 40, causing the safety bar 40 to tilt. The tilting starts to have effect on the brushes 21, 22 as soon as the safety bar 40 is in the position as can be seen in the second depiction of brushes 21, 22 and the safety bar 40. In that position, the tufts of the brush 21 shown at the left side are at an aggressive attacking angle with the safety bar 40, as a result of which a local strap brake is created at the sharp tip 42 of the safety bar 40. This effect takes place along the entire length of the brush 21, and is amplified by the fact that the tip 42 of the safety bar 40 is pushed more and more into the brush 21 by the incoming cord 31, 32 and under the influence of the rotating movement of the brushes 21, 22. The combination of the mass of the safety bar 40 (which causes an initial resistance to tilting on the basis of the phenomenon of mass inertia and thereby contributes to a sudden increase of torque as the safety bar 40 starts to engage the brush 21), the strap brake effect on the tip 42 of the safety bar 40, and the additional force on the safety bar 40, which is created by the brush 22 shown at the right side, will engage the clutch 24, 25 which is connected to the left brush 21.

As the safety bar 40 is made to rotate further, the situation as can be seen in the third depiction of brushes 21, 22 and the safety bar 40 is obtained. In this situation, the other sharp tip 43 of the safety bar 40 is at an aggressive angle of attack with the right brush 22. Due to the combination of factors as mentioned in the foregoing with respect to the left brush 21, also the clutch 24, 25 associated with the right brush 22 is activated to perform a decoupling function.

Hence, a final situation is a situation in which both brushes 21, 22 have stopped rotating, and both clutches 24, 25 of the safety mechanism are in a decoupling state, while the motor 23 is still running. At the bottom of FIG. 5, the whole of brushes 21, 22 and the safety bar 40 is shown with the safety bar 40 in a final position. In this position, the brushes 21, 22 do not experience any torque, because this is prohibited by the clutches 24, 25. When the motor 23 is switched off by a user of the cleaning device 1, the speed of the motor 23 decreases, and when the motor 23 is rotating at a relatively small frequency of only a few Hertz, an automatic reset of the safety bar 40 to a position in which contact between the safety bar 40 and the brushes 21, 22 is lost, i.e. a position which resembles the position as shown in the second depiction of the whole of brushes 21, 22 and the safety bar 40, is realized. This is due to a phenomenon that is well-known in the field of clutches as cogging, which involves a pulsating torque, on the basis of which the clutches 24, 25 drive the brushes 21, 22 such as to perform sudden, random movements in the low frequency range when speed is decreasing. Finally, when the motor 23 is switched on again, the safety bar 40 will be rotated back to the initial position, under the influence of dragging forces exerted by the brush hairs.

It follows from the foregoing that the safety bar 40 is an ideal tool for guaranteeing correct functioning of the clutches 24, 25 when a foreign object 31, 32 is encountered by the brushes 21, 22, wherein damage is prevented and unsafe situations for a user of the cleaning device 1 are avoided. The safety bar 40 does not require additional space in the brush accommodating head 10, is simple to manufacture, and is robust and reliable. Especially in cases when the foreign object 31, 32 would not be capable of engaging the brushes 21, 22 to such an extent that the clutches 24, 25 associated with the brushes 21, 22 are activated, which cases can be dangerous as the foreign object 31, 32 may still get damaged, the safety bar 40 is useful, as the foreign object 31, 32 will always cause the safety bar 40 to move from its initial position to a position for firmly engaging the brushes 21, 22 and thereby activating the clutches 24, 25 after all.

Once the safety mechanism of the cleaning device 1 has been activated, the user of the cleaning device 1 is assumed to take the foreign object 31, 32 out of the brush accommodating head 10 before starting the device 1 again. In that way, it is guaranteed that the foreign object will not be damaged, which is essential in case the object is an electric cord 31, 32 which can otherwise be stripped from its insulating layer, as explained in the foregoing. In order to ensure that a user is not enabled to start the cleaning device 1 without removing the foreign object first, it is proposed to use a mechanism which requires a reset after activation of the safety mechanism. For example, it is possible to provide sensors (not shown) for monitoring the rotation of the clutches 24, 25, which are adapted to turn off the cleaning device 1 and demand a reset after the clutches 24, 25 have started to slip. According to another possibility, the safety bar 40 is fitted with a sensor which turns off the cleaning device 1 and demands a reset after the safety bar 40 has rotated over an angle which is larger than a predetermined maximum angle, which may be 40 degrees, for example.

A practical issue associated with the use of a safety bar 40 is to find the right balance between sensitivity to incoming electric cords 31, 32 and robustness against false triggers. The geometry of the safety bar 40 is of great influence in this respect. For example, a safety bar 40 having a rectangular cross-sectional area can be arranged to touch the brushes 21, 22 with its long sides, before its (sharp) edges contact a first one of the brushes 21, 22 at an aggressive attacking angle. Thus, such a safety bar 40 is very stable against false triggers, but is less sensitive to incoming electric cords 31, 32. Also, when such a safety bar 40 is used, it is less likely that both clutches 24, 25 can be engaged at the same time, as is possible with the diamond shape as described in the foregoing.

A trimmed safety bar 40, for example, a safety bar 40 having a cross-sectional area which is shaped like a diamond as illustrated in FIG. 5, has far less contact with the brushes 21, 22 along its sides. This decreases its stability towards false triggers, but increases its sensitivity to cord pickup. With the diamond shape of the cross-sectional area of the safety bar 40, it is very likely that both clutches 24, 25 are engaged at the same time, because of a violent engagement between the safety bar 40 and the brushes 21, 22.

An advantageous shape of the cross-sectional area of the safety bar 40 is a combination between a rectangular shape and a diamond shape, as shown in FIG. 7. In this example, the safety bar 40 comprises a rectangular central portion 44 and two triangular portions 45, 46 located on opposite sides of the central portion 44. When the safety bar 40 is shaped in this way, a relatively high sensitivity to electric cords 31, 32 entering the brush accommodating head 10 is combined with a relatively high stability against false triggers.

As is known from motorbikes and bicycles, for example, the safety bar 40 can be made more stable by giving it lag. When the safety bar 40 is located at a position with is closer to the outside of the brush accommodating head 10 than the position shown in FIG. 5, which is a position at which the longitudinal axis 41 of the safety bar 40 and rotation axes of the brushes 21, 22 extend at the same level, the stability is increased.

It will be clear to a person skilled in the art that the scope of the present invention is not limited to the examples discussed in the foregoing, but that several amendments and modifications thereof are possible without deviating from the scope of the present invention as defined in the attached claims. While the present invention has been illustrated and described in detail in the figures and the description, such illustration and description are to be considered illustrative or exemplary only, and not restrictive. The present invention is not limited to the disclosed embodiments.

Variations to the disclosed embodiments can be understood and effected by a person skilled in the art in practicing the claimed invention, from a study of the figures, the description and the attached claims. In the claims, the word "comprising" does not exclude other steps or elements, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope of the present invention.

The present invention is described in the context of a cleaning device 1 comprising at least one brush 21, 22 having hairs which are extremely flexible, but that should not be understood to mean that the present invention is limited to the described context. In fact, the present invention is also applicable to brushes having other types of hairs. In general, the present invention is applicable in the context of a device for performing an action on a surface, comprising at least one movably arranged functional body at a side of the device intended for facing the surface. The movable arrangement of the functional body may be a rotatable arrangement, but may also be a linear arrangement, for example, an arrangement in which the functional body is capable of performing a reciprocating movement along a straight line when the device is operated. The device may be a cleaning device 1, but may also be a device which is suitable for polishing floors, for example. In any case, the present invention is applicable when there is a need for having a reliable safety mechanism in a device having at least one movably arranged functional body which may encounter foreign objects such as electric cords 31, 32 during operation of the device.

The present invention can be summarized as follows. A device 1 for performing an action on a surface 2 comprises at least one movably arranged functional body 21, 22, driving means 23 for driving the functional body 21, 22, main safety means 24, 25 for decoupling the driving means 23 from the functional body 21, 22 when a load exerted by the functional body 21, 22 in the direction of the driving means 23 under the influence of resistance forces experienced by the functional body 21, 22 exceeds a predetermined maximum value, and additional safety means 40 which are movably arranged in the vicinity of the functional body 21, 22, and which are capable of exerting loads on the main safety means 24, 25 to different extents in different positions, at a side of the main safety means 24, 25 associated with the functional body 21, 22.

In general, the additional safety means 40 may be adapted to exert loads on the main safety means 24, 25 in a direct manner or in an indirect manner. In the latter case, the additional safety means 40 are arranged such as to act on the main safety means 24, 25 through another component of the device 1, in other words, such as to cause the other component of the device 1 to exert loads on the main safety means 24, 25. For example, the additional safety means 40 may be capable of contacting the functional body 21, 22, as a result of which resistance forces acting at the functional body 21, 22 can be varied. In a practical embodiment, the additional safety means may comprise a bar 40 which is rotatable about its longitudinal axis 41, which has a non-circular cross-sectional area, and which is arranged such as to be capable of contacting the functional body 21, 22 in certain angular positions. According to another example, the additional safety means 41 may be arranged such as to move a pin or the like, which is capable of engaging the functional body 21, 22, the main safety means 24, 25, or a component at an intermediate position.

The invention claimed is:

1. A device for performing an action on a surface to be treated, comprising:

at least one movably arranged functional body facing said surface to be treated, at least one rotatable member configured to engage the surface to be treated, said rotatable member being rotatable about an axis generally parallel to the surface to be treated, driving means for driving the functional body, primary safety means in communication with the driving means and the movably arranged functional body, said primary safety means being configured to decouple the driving means from the functional body when a load exerted by the movably arranged functional body in the direction of the driving means under the influence of resistance forces experienced by the functional body exceeds a predetermined maximum value, secondary safety means movably arranged in the vicinity of the functional body, said secondary safety means being configured to exert a variable load on the primary safety means, said variable load being dependent upon a position of the secondary safety means relative to the primary safety means.

2. The device according to claim 1, wherein the secondary safety means are configured to contact the movably arranged functional body at a plurality of positions and thereby exert a different resistance force on the functional body for each of the plurality of positions.

3. The device according to claim 2, wherein the secondary safety means comprises an element for contacting the movably arranged functional body, said element being movable between at least a first position in which a level of contact between the element and the functional body is at a minimum, and at least a second position in which the level of contact is greater than the minimum.

4. The device according to claim 1, wherein the secondary safety means comprises an element which is rotatable about a rotation axis at a plurality of radial dimensions with respect to the rotation axis.

5. The device according to claim 1, wherein the secondary safety means comprises a bar which is rotatable about its longitudinal axis, and which has a non-circular cross-sectional area.

6. The device according to claim 5, wherein the bar of the secondary safety means has a diamond-shaped cross-sectional area.

7. The device according to claim 5, wherein the bar of the secondary safety means comprises a rectangular central portion and two triangular portions located on opposite sides of the central portion.

8. The device according to claim 5, wherein the movably arranged functional body is rotatable about a first axis, wherein the longitudinal axis of the bar of the secondary safety means extends at a level in the device further outward than the first axis about which the functional body is rotatable.

9. The device according to claim 8, wherein the level of the longitudinal axis of the bar is closer to the surface to be treated than an axis about which the functional body is rotatable with respect to the surface to be treated.

10. The device according to claim 1, comprising a further movably arranged functional body, wherein the secondary safety means are arranged at a position between the at least one movably arranged functional body and the further movably arranged functional body.

11. The device according to claim 1, wherein the movably arranged functional body comprises a brushy having soft and flexible brush hairs, wherein a linear mass density of the brush hairs is lower than 150 g per 10 km.

12. The device according to claim 1, wherein the primary safety means comprises a clutch which is arranged between the driving means and the movably arranged functional body, and wherein a decoupling action of the driving means comprises a slipping of the clutch.

13. The device according to claim 1, comprising:

sensing means for sensing a decoupling action of the primary safety means during operation of the device and responsively emitting a controlling signal whenever said decoupling action occurs, and controlling means for receiving the controlling signal from the sensing means, terminating the operation of the driving means upon receipt of the controlling signal, and prompting a user to initiate a manual reset of the device before the driving means can be re-started.

14. The device according to claim 13, wherein the primary safety means comprise a clutch which is arranged between the driving means and the functional body, and wherein a decoupling action of the driving means comprises a slipping of the clutch.

15. The device according to claim 1, comprising:

sensing means for sensing a movement of the secondary safety means during operation of the device and responsively emitting a controlling signal whenever the movement of the secondary safety means is larger than a predetermined limit, and controlling means for receiving the controlling signal, terminating the operation of the driving means upon receipt of the signal, and requiring a manual reset from a user of the device before the driving means can be re-started.

16. The device according to claim 15, wherein the secondary safety means comprise a bar which is rotatable about its longitudinal axis, the bar comprising a non-circular cross-sectional area, and wherein a predetermined maximum movement of the secondary safety means comprises a bar rotation not exceeding 40 degrees.

* * * * *